United States Patent [19]

Taniguchi et al.

[11] 4,085,249

[45] Apr. 18, 1978

[54] SEMICONDUCTIVE COMPOSITION HAVING CONTROLLED STRIPPABILITY

[75] Inventors: Seiho Taniguchi; Yoichi Kawasaki; Shin' Ichi Sugawara, all of Yokohama, Japan

[73] Assignee: Nippon Unicar Company Limited, Tokyo, Japan

[21] Appl. No.: 640,796

[22] Filed: Dec. 15, 1975

[30] Foreign Application Priority Data

Dec. 20, 1974 Japan ..... 49-145603

[51] Int. Cl.[2] ..... H01B 3/44

[52] U.S. Cl. ..... 428/383; 174/110 V; 174/110 PM; 260/42.52; 252/511; 427/118; 427/122

[58] Field of Search ..... 252/511; 427/118, 122; 428/383; 260/42.52; 174/110 V, 110 PW

[56] References Cited

U.S. PATENT DOCUMENTS

| | | | |
|---|---|---|---|
| 3,719,769 | 3/1973 | Miyouchi | 174/120 |
| 3,769,085 | 10/1973 | Matsubara | 117/218 |
| 3,816,347 | 6/1974 | Luh | 252/511 |

*Primary Examiner*—James H. Derrington
*Attorney, Agent, or Firm*—James J. O'Connell

[57] ABSTRACT

A semiconductive composition having controlled strippability from cross-linked ethylene polymer based insulation compositions and comprising chlorinated ethylene-vinyl acetate copolymer containing about 3 to 40 percent by weight of chlorine and conductive carbon black.

10 Claims, No Drawings

SEMICONDUCTIVE COMPOSITION HAVING CONTROLLED STRIPPABILITY

BACKGROUND OF THE INVENTION

1. Field of the Invention

This invention relates to improved resin based semiconductive compositions. More particularly this invention relates to resin based semiconductive compositions which exhibit controlled strippability when applied as an external semiconductive layer on cross-linked ethylene polymer based insulation which is employed in power cables.

2. Description of the Prior Art

Heretofore, power cables which are insulated with cross-linked ethylene polymer based insulation compositions have been further coated with an extruded semiconductive layer of a resin based composition. The semiconductive layer is applied to the insulation layer so as to closely adhere thereto and provide a gas and moisture tight seal between the two layers. The resin based semiconductive compositions which have been heretofore used for this purpose include cross-linkable compositions which are based on ethylene-ethyl acrylate or ethylene-vinyl acetate copolymers, and which also contain conductive carbon black and organic peroxides as crosslinking agents. When the thus coated power cables are used in the field, however, portions of the external semiconductive layer have to be completely removed, relatively quickly, from the cable for certain purposes. The need for thus quickly removing portions of the semiconductive layer from the insulated power cable may arise, for example, in making connections between two ends of such cables, and also when joining the cables to terminals. For such purposes, therefore, it is highly desirable that the semiconductive layer be readily strippable from the insulation layer to which it adheres.

This requirement, that the semiconductive layer be readily strippable from the insulation layer, has not been met by many conventionally used resin based semiconductive compositions. Many of the conventional semiconductive compositions adhere too strongly to the insulation layer, thereby rendering it impossible to readily strip or peel the semiconductive layer from the insulation layer. Where the semiconductive layer adheres too strongly to the insulation layer it may require too long a time, for practical purposes, to adequately remove the desired amount of semiconductive material from the insulation layer. Also, in the process of removing a strongly adhering semiconductive layer, portions of the underlying insulation layer may be unintentionally pulled off too, thus damaging the insulation layer. It is highly desirable, therefore, for commercial purposes, to provide resin based semiconductive compositions which can be used as external, adhering, coatings for power cable insulated with cross-linked ethylene polymer based insulation compositions, and which can be readily stripped away from the insulation layer when necessary.

SUMMARY OF THE INVENTION

An object of the present invention, therefore, is to provide an improved resin based semiconductive composition which exhibits controlled strippability when adheringly applied, as an external semiconductive layer, on the insulation layer of power cable, where such insulation layer comprises a crosslinked ethylene polymer based insulation composition.

A further object of the present invention is to provide power cable which is insulated with a cross-linked ethylene polymer based insulation composition with an external, adhering, coating of a resin based semiconductive composition which is readily strippable from such insulated cable.

Another object of the present invention is to provide a method of coating power cable, which cable is insulated with a cross-linked ethylene polymer, with an external resin based semiconductive composition which has a controlled degree of strippability from the insulation layer.

These and other objects of the present invention are obtained by the use of a semiconductive resin based composition which comprises chlorinated, ethylene-vinyl acetate copolymer and conductive carbon black.

DESCRIPTION OF THE PREFERRED EMBODIMENT

The objects of the present invention are achieved by employing, as a semiconductive composition, a composition comprising, in the amounts noted further below:

(a) chlorinated ethylene-vinyl acetate copolymer,
(b) conductive carbon black,
(c) organic peroxide curing agent for the chlorinated ethylene-vinyl acetate copolymer, and
(d) antioxidant for the chlorinated ethylene-vinyl acetate copolymer.

CHLORINATED ETHYLENE-VINYL ACETATE COPOLYMER

The chlorinated ethylene-vinyl acetate copolymer used in the semiconductive compositions of the present invention is a solid, at 25° C, resin which contains about 3 to 40, and preferably about 5 to 30 percent by weight of chlorine. These chlorinated resins may be produced by chlorinating ethylene-vinyl acetate copolymers in conventional chlorination procedures. In one such procedure the chlorinated copolymer may be prepared by bubbling chlorine gas into an organic solvent solution of the ethylene-vinyl acetate copolymer until the desired degree of chlorination is achieved. This, and other suitable chlorination procedures that may be used for this purpose are disclosed in Japanese Patent Publication No. 48-33019.

The procedures of such disclosures are hereby incorporated herein by reference.

A preferred ethylene-vinyl acetate copolymer which may be used to prepare the chlorinated copolymer of the present invention is one having a vinyl acetate content of from about 15 to 50 percent by weight, an ethylene content of from about 50 to 85 percent by weight, and a melt index of from about 1.0 to about 50 grams/10 minutes as measured by ASTM procedure D-1238.

After being chlorinated, the chlorinated copolymer of the present invention has a melt index value of from about 0.8 to about 45 grams/10 minutes as measured by ASTM Procedure D-1238.

The ethylene-vinyl acetate copolymer which is chlorinated to form the chlorinated copolymer of the present invention may also contain minor amounts, of about less than 5 weight percent, of one or more interpolymerized monomers other than ethylene and vinyl acetate, such as $C_3$ to $C_6$ mono-alpha olefins, including propylene, butene-1, pentene-1 and hexene-1; and acrylic acid and methacrylic acid and the $C_1$ to $C_8$ alkyl esters of such acids such as ethyl acrylate, butyl acrylate, 2-ethyl hexyl acrylate and methyl methacrylate; and other vinyl esters such as vinyl propionate and vinyl butyrate.

It has been unexpectedly found by the present inventors that a chlorinated ethylene-vinyl acetate copolymer which contains less than about 15 percent by weight of vinyl acetate and less than about 3 percent by weight of chlorine, when employed in a semiconducting layer on the cross-linked ethylene polymer based insulation of power cable, cannot be readily peeled off such insulation. It has also been found that a chlorinated ethylene-vinyl acetate copolymer which contains more than about 50 percent by weight of vinyl acetate and more than about 40 percent by weight of chlorine, has poor adhesion, as a semiconducting layer, to the cross-linked ethylene polymer based insulation of power cable.

Carbon Black

The carbon black which is used in the semiconducting compositions of the present invention includes all electrically conductive carbon blacks, including furnace blacks, acetylene blacks, and channel blacks. The carbon black should have a particle size of the order of about 10 to 60 millimicrons. About 40 to 100, and preferably about 55 to 75, parts by weight of the carbon black is used per 100 parts by weight of the chlorinated ethylene-vinyl acetate copolymer in the semiconductive composition.

ORGANIC PEROXIDE CURING AGENT

The organic peroxide curing agent which is used in the semiconductive compositions of the present invention include all organic peroxide compounds which are capable of providing free radicals for cross-linking the chlorinated ethylene-vinyl acetate copolymer under the cross-linking conditions employed for the semiconductive compositions.

The organic peroxide compounds can be used individually or in combination with one another.

The preferred organic peroxide compounds which may be used in the semiconductive compositions of the present invention may also be generally classified as those in which each oxygen atom of each peroxide group is directly bonded to a tertiary carbon atom whose remaining valences are attached to hydrocarbon radicals selected from the group consisting of alkyl, cycloalkyl, aryl and aralkyl. Peroxides of this type are generally disclosed in U.S. Pat. No. 2,888,424. Examples of the organic peroxide compounds which may be used in the semiconductive compositions of the present invention would include di-α-cumyl peroxide
2,5-dimethyl-2,5-di(t-butyl peroxy)-hexyne-3
2,5-dimethyl-2,5-di(t-butyl peroxy)-hexane
t-butyl cumyl peroxide
di-t-butyl peroxide
α,α'-bis(t-butyl peroxy)-p-di-isopropyl benzene
2,5-dimethyl-2,5-di(benzoyl peroxy)-hexane
t-butyl peroxy isopropyl carbonate.

The organic peroxide compounds are used in cross-linking effective amounts in the semiconductive compositions of the present invention which may range from about 0.1 to 8.0, and preferably about 0.3 to 5.0, parts by weight of organic peroxide compound per 100 parts by weight of chlorinated ethylene-vinyl acetate copolymer in such compositions.

ANTIOXIDANT

The semiconductive compositions of the present invention also advantageously include about 0.01 to 3.0 and, preferably 0.05 to 1.0, parts by weight of one or more suitable high temperature antioxidants for the chlorinated ethylene-vinyl acetate copolymers, per 100 parts by weight of the chlorinated copolymer in such compositions.

These antioxidants are preferably sterically hindered phenols. Such compounds would include 1,3,5-trimethyl-2,4,6-tris(3,5-ditertiary butyl-4-hydroxy benzyl)benzene;
1,3,5-tris(3,5-ditertiary butyl-4-hydroxy benzyl)-5-triazine-2,4,6-(1H,3H,5H)trione;
tetrakis- [methylene-3-(3',5-di-t-butyl-4'-hydroxy phenyl)-propionate] methane; and
di(2-methyl-4-hydroxy-5-t-butyl phenyl)sulfide.

Polymerized 2,2,4-trimethyl dihydroquinoline may also be used.

The antioxidants may be used individually, or in combination with one another.

ADJUVANTS FOR SEMI CONDUCTIVE COMPOSITION

In addition to the chlorinated ethylene-vinyl acetate copolymer, the conductive carbon black, the organic peroxide-cross-linking agent and the antioxidant, the semiconductive compositions of the present invention may also contain one or more adjuvant materials of the types normally used in resin based semiconducting compositions.

These other adjuvants would include organic waterproofing fillers; inorganic fillers such as clay, talc and calcium carbonate; lubricants, stabilizers; voltage stabilizers, metal deactivators, auxiliary curing agents, and processing aids.

These adjuvants would be used in amounts designed to provide their intended effect in the resulting semiconducting composition. The total amount of such adjuvants will range from 0 to about 20 weight percent based on the total weight of the semiconducting composition.

CROSSLINKED INSULATING COMPOSITION

The semiconductive compositions of the present invention, as noted above, are applied as an external layer, onto a layer of crosslinked ethylene polymer based insulation on a power cable. The crosslinked ethylene polymer based insulation composition comprises, in the amounts noted further below:

(a) non-chlorinated ethylene polymer,
(b) organic peroxide curing agent for the nonchlorinated ethylene polymer, and
(c) antioxidant for the non-chlorinated ethylene polymer.

NON-CHLORINATED ETHYLENE POLYMER

The non-chlorinated ethylene polymers which are used in the insulation compositions of the present invention are solid (at 25° C.) materials which may be non-chlorinated homopolymers, or non-chlorinated copolymers of ethylene. The non-chlorinated ethylene copolymers may contain at least 30 weight percent of ethylene and up to about 70 weight percent of propylene, and/or up to about 50 weight percent of one or more other organic compounds which are interpolymerizable with ethylene. These other compounds which are interpolymerizable with ethylene are preferably those which contain polymerizable unsaturation, such as is present in compounds containing an ethylene linkage, $>C=C<$. These other interpolymerizable compounds may be hydrocarbon compounds such as, butene-1, pentene-1, isoprene, butadiene, bicycloheptene, bicycloheptadiene, and styrene, as well as vinyl compounds such as vinyl acetate and ethyl acrylate.

These copolymers could thus include those containing >0 to 70 weight percent of propylene and 30 to <100 weight percent of ethylene; and >0 to 21 50 weight percent of butene-1 or ethylene vinyl acetate and 50 to <100 weight percent of ethylene; and >0 to <30 weight percent of propylene, >0 to 20 weight percent of butene-1 and 50 to <100 weight percent of ethylene.

The non-chlorinated ethylene polymers may be used individually, or in combinations thereof. The ethylene polymers have a density (ASTM 1505 test procedure with conditioning as in ASTM D-1248-72) of about 0.86 to 0.96 and a melt index (ASTM D-1238 at 44 psi test pressure) of about 0.1 to 20 decigrams per minute.

CURING AGENT AND ANTIOXIDANT FOR INSULATION COMPOSITION

The organic peroxide curing agents and antioxidants which are used in the semiconductive composition of the present invention may also be used in the insulation compositions. About 0.1 to 8.0, and preferably about 0.3 to 5.0, parts by weight of the curing agent would be used per 100 parts by weight of non-chlorinated ethylene polymer in the insulation composition. About 0.01 to 3.0, and preferably about 0.05 to 1.0, parts by weight of the antioxidant would be used per 100 parts by weight of non-chlorinated ethylene polymer in the insulation composition.

ADJUVANTS FOR INSULATION COMPOSITION

In addition to the non-chlorinated ethylene polymer, the curing agent and the antioxidant, the insulation compositions may also contain one or more adjuvant materials of the types normally used in cross-linked ethylene polymer based insulation compositions. Such adjuvants would include those described above, and the amounts thereof, for use in the semi-conductive compositions.

Processing of the Compositions

Each of the semi-conductive composition and the insulating composition are formed separately. All of the components of each of these compositions are usually blended or compounded together prior to their introduction into the extrusion device from which they are to be extruded either onto an electrical conductor, in the case of the insulation composition, or onto the insulation composition in the case of the semiconductive composition. The base polymer of each composition, and the other desired constituents thereof, may be blended together by any of the techniques used in the art to blend and compound thermoplastics to homogeneous masses. For instance, the components may be fluxed on a variety of apparatus including multi-roll mills, screw mills, continuous mixers, compounding extruders and Banbury mixers, or dissolved in mutual or compatible solvents.

When all the solid components of the composition are available in the form of a powder, or as small particles, the compositions are most conveniently prepared by first making a blend of the components, say in a Banbury mixer or a continuous extruder, and then masticating this blend on a heated mill, for instance on a two-roll mill, and the milling continued until an intimate mixture of the components is obtained. Alternatively, a master batch containing the base polymer(s) and the antioxidant(s) and, if desired, some or all of the other components, may be added to the mass of polymer. Where the base polymer is not available in powder form, the compositions may be made by introducing the polymer to the mill, masticating it until it forms a band around one roll, after which a blend of the remaining components is added and the milling continued until an intimate mixture is obtained. The rolls are preferably maintained at a temperature which is within the range 80° C. to 150° C. and which is below the decomposition temperatures of the peroxide compound(s). The composition, in the form of a sheet, is removed from the mill and then brought into a form, typically dice-like pieces, suitable for subsequent processing.

After the various components of the compositions are uniformly admixed and blended together, they are further processed, in accordance with the process of the present invention, in conventional extrusion apparatus at about 120° to 160° C.

After being extruded onto a wire or cable, the insulation compositions are vulcanized at elevated temperatures of about >180° C. and preferably at >215°-230° C. using conventional vulcanizing procedures. The semiconducting compositions of the present invention are vulcanized under the same conditions.

The semiconducting compositions of the present invention may be applied onto the insulation composition by known extrusion procedures. The semiconducting layer can be applied onto the layer of insulation material after the insulation layer is vulcanized, and then the semiconducting layer can be separately vulcanized. The semiconducting layer can also be applied, in a thermoformable i.e., uncrosslinked or uncured, state, onto the insulation layer, while the insulation layer is in a thermoformable state, and then both layers can be vulcanized simultaneously. The semi-conducting layer can also be vulcanized before it is applied to the unvulcanized layer of insulation material. In all cases, at least one layer must be unvulcanized at the time the two layers are laminated together.

The following examples are merely illustrative of the present invention and are not intended as a limitation upon the scope thereof.

Several semiconductive compositions were produced by compounding, in a Banbury mixer, 100 parts by weight of each of various solid polymers as the base resin, 65 parts by weight of conductive carbon black, 0.8 parts by weight of an antioxidant which was polymerized 2,2,4-trimethyl dihydroquinoline, 1 part by weight of lead stearate (which was employed as a stabilizer), and 0.11 percent by weight (based on the theoretically available amount of active oxygen therein) of a cross-linking agent which was 2,5-dimethyl-2,5-di (tertiary butylperoxy)-hexyne-3.

The resulting semiconductive composition was then formed into a sheet which was 0.5 mm thick, 150 mm long and 180 mm wide, by molding the composition in a compression molding press for 10 minutes at 120° C. under a pressure of 85 kgs/cm$^2$.

The polymers used as the base resins in these compositions are listed below in Table I.

An insulating composition was also prepared by compounding, in a Banbury mixer, 97.8 parts by weight of a solid ethylene homopolymer having a density of 0.92 and a melt index of 2 grams/10 minutes, 2 parts by weight of a crosslinking agent which was di-α-cumyl peroxide and 0.2 parts by weight of an antioxidant which was bis(2-methyl-5-t-4-hydroxy phenyl)sulfide.

The resulting insulating composition was then formed into a sheet which was 2.0 mm thick, 150 mm long and 180 mm wide by being compression molded as was the semi conductive composition. Each sheet was still uncrosslinked at this stage of their processing.

Laminated compositions were then prepared by laminating a sheet of the insulating composition with a sheet of each of the semiconductive compositions that were prepared as disclosed above. each laminated structure was formed by compressing together, one on top of the other, the sheet of insulating composition and the sheet of semiconductive composition in a compression molding press for 15 minutes at a temperature of 180° C. and at a pressure of 20 kg/cm$^2$. The insulation composition layer and the semiconductive composition layer were simultaneously crosslinked under these conditions. A 10 mm wide and 120 mm long specimen was then cut from the laminated sheet and subjected to a peel strength test as described below.

The peel strength test was conducted by attempting to peel off the layer of the crosslinked semiconductive composition from the layer of the crosslinked insulation composition. The layer of semiconductive material was peeled off at an angle of 90° with respect to the insulation layer using a tensile strength tester. The test specimens were tested at 25° C. and the sheets were pulled apart at the rate of 500 mm/minute. The force required to peel off the semiconductive sheet was regarded as the peeling strength of the semiconductive composition and was reported in terms of kg/10 mm.

Several Control Experiments were also run using semiconductive compositions made with various polymers.

Table I below lists the base polymer used in each of the tested semiconductive compositions, and the peel strength of such semiconductive composition.

The base polymers in the semiconductive composition was an unchlorinated ethylene-vinyl acetate (EVA) copolymer with a given weight percent content of vinyl acetate (VA); or a chlorinated EVA copolymer with a given weight % content of VA and chlorine (Cl); or an unchlorinated ethylene-ethyl acrylate (EEA) copolymer with a given percent content of ethyl acrylate (EA); or a chlorinated EEA copolymer with a given weight percent content of EEA and Cl; or a chlorinated homopolymer of ethylene (PE) with a given weight percent content of Cl, and which was amorphous or 2 to 10% crystalline. The melt index (MI) of the copolymers is also given.

TABLE I

| Ex. No. | Control No. | Base Polymer for Semiconductive Composition | Peel Strength (kg/10 mm) |
|---|---|---|---|
| | 1 | EVA VA: 28%, MI: 6 | 4.0 |
| 1 | | Chlorinated EVA VA: 28%, MI: 6, Cl: 3 wt% | 2.5 |

TABLE I-continued

| Ex. No. | Control No. | Base Polymer for Semiconductive Composition | Peel Strength (kg/10 mm) |
|---|---|---|---|
| 2 | | Chlorinated EVA VA: 28%, MI: 6, Cl: 5 wt% | 2.1 |
| 3 | | Chlorinated EVA VA: 28%, MI: 6, Cl: 10 wt% | 1.4 |
| 4 | | Chlorinated EVA VA: 28%, MI: 6, Cl: 25 wt% | 1.5 |
| 5 | | Chlorinated EVA VA: 28%, MI: 6, Cl: 30 wt% | 1.5 |
| | 2 | EVA VA: 28%, MI: 20 | 4.7 |
| 6 | | Chlorinated EVA VA: 28%, MI: 20, Cl: 25 wt% | 1.3 |
| | 3 | EVA VA: 18%, MI: 2.5 | could not be peeled |
| 7 | | Chlorinated EVA VA: 18%, MI: 2.5, Cl: 5 wt% | 3.5 |
| 8 | | Chlorinated EVA VA: 18%, MI: 2.5, Cl: 20 wt% | 2.1 |
| | 4 | Chlorinated EVA VA: 18%, MI: 2.5, Cl: 60 wt% | poor adhesion |
| | 5 | EVA VA: 10%, MI: 3 | could not be peeled |
| | 6 | Chlorinated EVA VA: 10%, MI: 3, Cl: 10 wt% | could not be peeled |
| | 7 | EVA VA: 33%, MI: 30 | 3.0 |
| 9 | | Chlorinated EVA VA: 33%, MI: 30, Cl: 10 wt% | 1.3 |
| | 8 | EEA EA: 20%, MI: 6 | could not be peeled |
| | 9 | Chlorinated EEA EA: 20%, MI: 6 Cl: 20 wt% | could not be peeled |
| | 10 | Chlorinated EEA EA: 20% MI: 6, Cl: 40 wt% | could not be peeled |
| | 11 | Chlorinated PE Cl: 35 wt%, Crystallinity: 2–10% | 3.3 |
| | 12 | Chlorinated PE Cl: 40 wt%, amorphous | could not be peeled |

The results of the experiments, as reported in Table I above, demonstrate that the applicant's semiconductive compositions, i.e., those of his Examples 1 to 9, could be readily peeled from the insulation composition. Only certain of the semiconductive compositions of the twelve control experiments could be peeled from the insulation compositions, and only then if a relatively large force was applied (>3.0 kg/10 mm), as in Control experiments 1, 2, 7 and 11. In the other Control experiments the semiconductive composition could not be peeled off at all without breakage using a maximum applied force of about 7 kg/10 mm.

Although the compositions of Control experiments 7 and 11 had peel strengths which were comparable to that of the composition of Example 7, the composition of Control experiments 7 and 11 had disadvantages which were not present in the composition of Example 7, or in the other semiconductive compositions of the present invention. The composition of Control experiment 7 has a tendency to scorch during the processing thereof and the composition of Control experiment 11 has poor flow properties and thus is difficult to process in the melt and is therefore susceptible to thermal decomposition. The semi-conductive compositions of the present invention, on the other hand, do not have these disadvantages.

What is claimed is:

1. A semiconductive composition comprising chlorinated ethylene-vinyl acetate copolymer, said copolymer containing about 3 to 40 weight percent of chlorine and having a vinyl acetate content of about 15 to 50 percent by weight, and sufficient amounts of electrically conductive carbon black as to render said composition semiconductive.

2. A composition as in claim 1 in which said copolymer contains about 5 to 30 weight percent of chlorine.

3. A composition as in claim 1 in which said copolymer is obtained by chlorinating an ethylene-vinyl acetate copolymer having a melt index of about 1.0 to 50 grams/10 minutes.

4. A composition as in claim 1 which comprises about 40 to 100 parts by weight of carbon black per 100 parts by weight of said copolymer.

5. Power cable insulated with a cross-linked ethylene polymer based insulation composition, said insulation composition having applied thereon an external layer of the composition of claim 1.

6. Power cable insulated with a cross-linked ethylene polymer based insulation composition, said insulation composition having applied thereon an external layer of the composition of claim 2.

7. Power cable insulated with a cross-linked ethylene polymer based insulation composition, said insulation composition having applied thereon an external layer of the composition of claim 4.

8. A method of providing insulated power cable with a semi-conductive external coating which has a controlled degree of strippability from the insulation layer of said cable which comprises:

(a) coating an electrical conductor with an insulation composition comprising crosslinked ethylene polymer, and (b) applying to said insulation coating composition a coating of a semi-conductive composition whereby such semi-conductive coating composition firmly adheres to but is strippable from said insulation coating composition, said semiconductive composition comprising chlorinated ethylene-vinyl acetate copolymer and sufficient amounts of electrically conductive carbon black as to render said composition semi-conductive and the degree of strippability of said semi-conductive coating composition being inversely proportional to the chlorine content of said chlorinated ethylenevinyl acetate copolymer, said copolymer containing about 3 to 40 weight percent of chlorine and having a vinyl acetate content of about 15 to 50 percent by weight.

9. A method as in claim 8 in which said semi-conductive coating composition comprises about 40 to 100 parts by weight of electrically conductive carbon black per 100 parts by weight of said chlorinated copolymer.

10. A method as in claim 9 in which said chlorinated copolymer contains about 5 to 30 percent by weight of chlorine and is formed by chlorinating an ethylene-vinyl acetate copolymer having a melt index of about 1.0 to 50 grams/10 minutes.

* * * * *

UNITED STATES PATENT OFFICE

CERTIFICATE OF CORRECTION

Patent No. 4,085,249 Dated April 18, 1978

Inventor(s) S. Taniguchi et al.

It is certified that error appears in the above-identified patent and that said Letters Patent are hereby corrected as shown below:

Column 5, line 11, "21 50" should read --<50--.

Column 6, line 29, ">180°C." should read --≥180°C.--.

Column 6, line 29, ">215°" should read --≥215°--.

Column 8, line 52, ">3.0" should read --≥3.0--.

Column 10, line 19, "ethylenevinyl" should read --ethylene-vinyl--.

Signed and Sealed this

Twelfth Day of December 1978

[SEAL]

Attest:

RUTH C. MASON
Attesting Officer

DONALD W. BANNER
Commissioner of Patents and Trademarks